US006641667B2

(12) United States Patent
Ochiai et al.

(10) Patent No.: US 6,641,667 B2
(45) Date of Patent: Nov. 4, 2003

(54) ROBOT-MOUNTED TWO-PACKAGE-MIXING COATING DEVICE AND INTERNAL PRESSURE EXPLOSION-PROOF ROBOT

(75) Inventors: Hiroshi Ochiai, Utsunomiya (JP); Hiroyoshi Nozaki, Utsunomiya (JP); Hidenori Taguchi, Utsunomiya (JP); Shinobu Tokin, Utsunomiya (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 2 days.

(21) Appl. No.: 09/933,659

(22) Filed: Aug. 22, 2001

(65) Prior Publication Data

US 2002/0043280 A1 Apr. 18, 2002

(30) Foreign Application Priority Data

Aug. 29, 2000 (JP) ..... 2000-259723
Oct. 18, 2000 (JP) ..... 2000-317866

(51) Int. Cl.[7] ..... B05B 13/02

(52) U.S. Cl. ..... 118/323; 118/321; 901/43; 901/15

(58) Field of Search ..... 118/323, 684, 118/305, 317, 321, 631; 414/729, 730; 901/15, 27, 29, 41, 43

(56) References Cited

U.S. PATENT DOCUMENTS 4,591,944 A * 5/1986 Gravel ..... 361/170
4,666,363 A * 5/1987 Johansson ..... 414/736
5,049,797 A * 9/1991 Phillips ..... 318/568.16
5,114,752 A * 5/1992 Hall ..... 427/273
5,254,828 A * 10/1993 Stiebel ..... 219/110
5,655,412 A * 8/1997 Luik ..... 74/490.01
5,949,209 A 9/1999 Okamoto et al.

FOREIGN PATENT DOCUMENTS

| | | |
|---|---|---|
| GB | 742859 | 1/1956 |
| GB | 775232 | 5/1957 |
| JP | 10138190 | 5/1998 |
| JP | 11244743 | 9/1999 |

* cited by examiner

*Primary Examiner*—Richard Crispino
*Assistant Examiner*—Yewebdar T Tadesse
(74) *Attorney, Agent, or Firm*—Birch, Stewart, Kolasch & Birch, LLP

(57) ABSTRACT

A robot arm with a coating gun mounted on a distal end thereof houses therein a first color changing valve mechanism for supplying a base compound, an electropneumatic transducer, and a second color changing valve mechanism for supplying a hardener, which are successively arranged in the order named toward the coating gun. The base compound and the hardener supplied from these mechanisms controlled by the electropneumatic transducer can be mixed highly accurately at a desired mixing ratio, and applied to coat a workpiece with a high-quality coating layer.

6 Claims, 6 Drawing Sheets

ROBOT-MOUNTED TWO-PACKAGE-MIXING COATING DEVICE AND INTERNAL PRESSURE EXPLOSION-PROOF ROBOT

BACKGROUND OF THE INVENTION

1. Field of the Invention

The present invention relates to a robot-mounted two-package-mixing coating device for supplying a coating gun mounted on the distal end of a robot arm with a base compound and a hardener to coat a workpiece, and an internal pressure explosion-proof robot having a robot arm including electric devices housed in a pressurization chamber which is supplied with air under pressure.

2. Description of the Related Art

There has been used a two-package-mixing coating device for mixing a base compound and a hardener with each other and discharging the mixture to coat an object such as an automotive body or the like. One known two-package-mixing coating device mounted on a robot is disclosed in Japanese laid-open patent publication No. 11-244743, for example.

Such a conventional robot-mounted two-package-mixing coating device will be described below with reference to FIG. 6 of the accompanying drawings. As shown in FIG. 6, a coating robot 1 has a robot arm 2 supporting a bell-shaped coating gun 3 on its wrist. The robot arm 2 also supports thereon a base compound control valve assembly 4*a* and a hardener control valve assembly 4*b* which are juxtaposed in the longitudinal direction of the robot arm 2. The robot arm 2 houses therein a base compound metering pump 5*a* and a hardener metering pump 5*b* which are combined with respective motors 6*a*, 6*b*. Between the control valve assemblies 4*a*, 4*b* and the coating gun 3, there is disposed a mixer 7 for mixing a base compound and a hardener that are supplied with each other and supplying the mixture to the coating gun 3.

The base compound control valve assembly 4*a* has a plurality of coating ports associated with respective valves, and the hardener control valve assembly 4*b* has a plurality of coating ports associated with respective valves. The valve associated with one of the coating ports of the base compound control valve assembly 4*a* is actuated to open the coating port to supply a desired base compound to the base compound metering pump 5*a*, and the valve associated with one of the coating ports of the hardener control valve assembly 4*b* is actuated to open the coating port to supply a desired hardener to the hardener metering pump 5*b*. The base compound metering pump 5*a* and the hardener metering pump 5*b* are controlled for the ratio of their rotational speeds by the motors 6*a*, 6*b* to supply the base compound and the hardener at desired rates to the mixer 7. The mixer 7 mixes the base compound and the hardener with each other, and supplies the mixture to the coating gun 3, which atomizes and applies the mixture to a workpiece (not shown) to be coated.

With the conventional robot-mounted two-package-mixing coating device, the base compound control valve assembly 4*a* and the hardener control valve assembly 4*b* are juxtaposed and mounted on the robot arm 2. Therefore, an electropneumatic transducer (not shown) for turning on and off the supply of air to the valves of the base compound control valve assembly 4*a* and the hardener control valve assembly 4*b* is spaced from the base compound control valve assembly 4*a* and the hardener control valve assembly 4*b* by different distances.

Consequently, the valves of the base compound control valve assembly 4*a* and the hardener control valve assembly 4*b* respond to the supplied air at different times, failing to accurately regulate the mixing ratio of the base compound and the hardener. One solution would be to juxtapose the base compound control valve assembly 4*a* and the hardener control valve assembly 4*b* transversely across the robot arm 2. However, since the base compound control valve assembly 4*a* and the hardener control valve assembly 4*b* are relatively large in structure, the robot arm 2 would be required to have an increased transverse dimension that would be practically unacceptable.

The hardener is discharged at a rate smaller than the base compound, and a pipe for supplying the hardener is thinner than a pipe for supplying the base compound. The hardener is more viscous than the base compound. Therefore, it takes a considerable period of time to clean the interior of the pipe for supplying the hardener when coating colors are to be changed. Since the pipes extending from the base compound control valve assembly 4*a* and the hardener control valve assembly 4*b* to the coating gun 3 have substantially the same length, the pipe for supplying the hardener needs to be cleaned over an additional period of time even after the cleaning of the pipe for supplying the base compound has been completed. As a result, the tact time for changing coating colors is limited by the period of time required to clean the pipe for supplying the hardener.

The coating robot 1 is constructed as an internal pressure explosion-proof robot for use in a coating booth which contains an explosive atmosphere.

Japanese laid-open patent publication No. 10-138190, for example, discloses an internal pressure explosion-proof robot having a plurality of pressurization chambers which are hermetically sealed independently of each other without mutual communication and houses electric motors and cables. Air under pressure is supplied individually to the pressurization chambers through respective partitions.

With the above conventional internal pressure explosion-proof robot, the electric motors and the cables are accommodated in a robot arm which is basically of a tubular shape such as a cylindrical shape or a prismatic shape. The robot arm houses therein the partitions that define the pressurization chambers. If an explosion-proof structure is employed in a portion of the robot arm, then the internal structure of the robot arm becomes considerably complex, making the robot highly costly to manufacture.

SUMMARY OF THE INVENTION

It is a general object of the present invention to provide a robot-mounted two-package-mixing coating device which is of a simple structure capable of supplying a coating gun with a base compound and a hardener highly accurately at a desired mixing ratio, coating a workpiece with a high-quality coating layer stably, and cleaning supply pipes in a reduced period of time.

A major object of the present invention is to provide an internal pressure explosion-proof robot which is of a simple structure and has a desired explosion-proof structure that can easily be incorporated.

According to the present invention, a robot-mounted two-package-mixing discharging device has a robot arm with a coating gun mounted on a distal end thereof, and a base compound supply control mechanism, an electropneumatic transducer, and a hardener supply control mechanism which are mounted in the robot arm and successively arranged in the robot arm in the order named toward the coating gun. Since the electropneumatic transducer is disposed between the base compound supply control mechanism and the hardener supply control mechanism, passages for supplying air from the electropneumatic transducer to the base compound supply control mechanism and the hardener supply control mechanism have respective lengths that are substantially the same as each other. The base compound supply control mechanism and the hardener supply control mechanism can thus respond at the same time to air supplied from the electropneumatic transducer. The base compound and the hardener are thus discharged at stable rates and mixed highly accurately at a desired mixing ratio. As a result, a high-quality coating layer can be applied to a workpiece.

The hardener supply control valve mechanism is positioned more closely to the coating gun than the base compound control valve mechanism. Therefore, a hardener supply passage is shorter than a base compound supply passage, and the time required to clean the hardener supply passage is effectively reduced. As a consequence, the cleaning process that is carried out when coating colors are changed in the coating device is efficiently performed.

According to the present invention, an internal pressure explosion-proof robot has a robot arm constructed of a steel bar having an I-shaped or H-shaped cross section, and a lid mounted on at least one side of the robot arm, providing a closed pressurization chamber defined by the robot arm and the lid. Consequently, the robot arm itself maintains a desired level of mechanical strength with a simple and inexpensive structure, and allows a desired explosion-proof structure to be incorporated in a portion thereof. The explosion-proof structure is simple and highly versatile.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
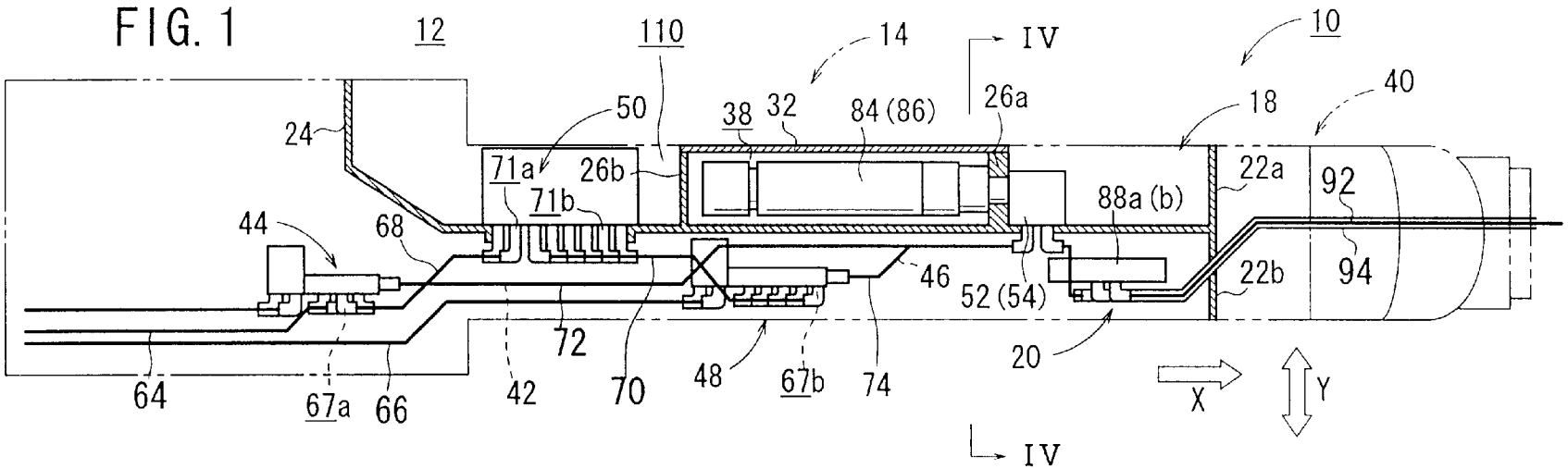
FIG. 1 is a plan view showing an internal structure of an internal pressure explosion-proof coating robot which incorporates a robot-mounted two-package-mixing coating device according to an embodiment of the present invention.
Figure 2:
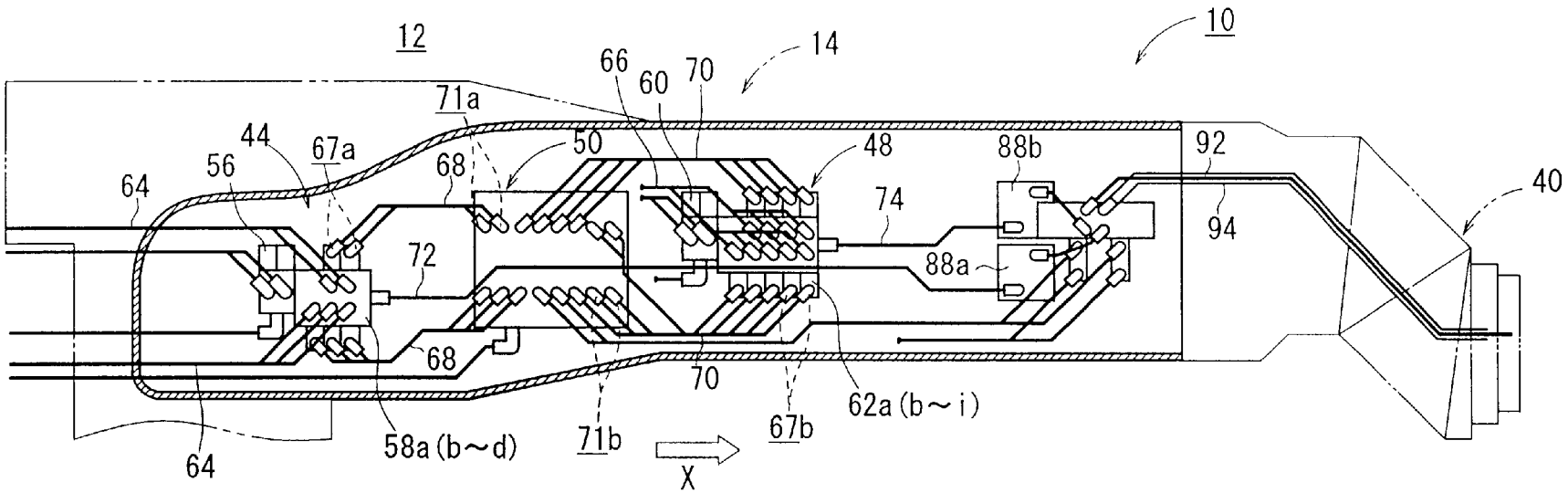
FIG. 2 is a side elevational view showing an internal structure of the internal pressure explosion-proof coating robot.

FIG. 1 shows in plan an internal structure of an internal pressure explosion-proof coating robot 12 which incorporates a robot-mounted two-package-mixing coating device 10 according to an embodiment of the present invention. FIG. 2 shows in side elevation an internal structure of the internal pressure explosion-proof coating robot 12.

Figure 3:
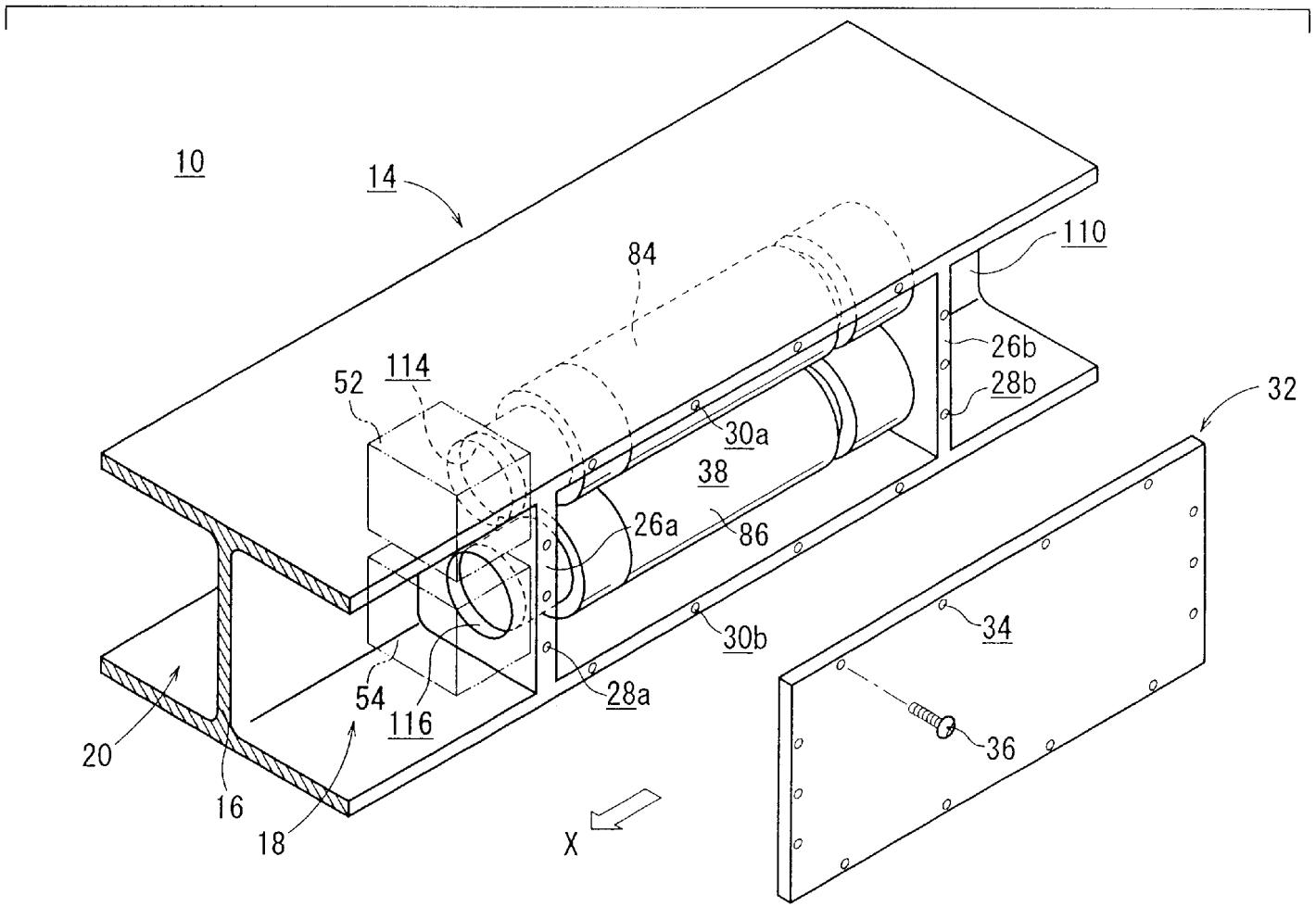
FIG. 3 is an exploded perspective view of a portion of a robot arm of the internal pressure explosion-proof coating robot.
Figure 4:
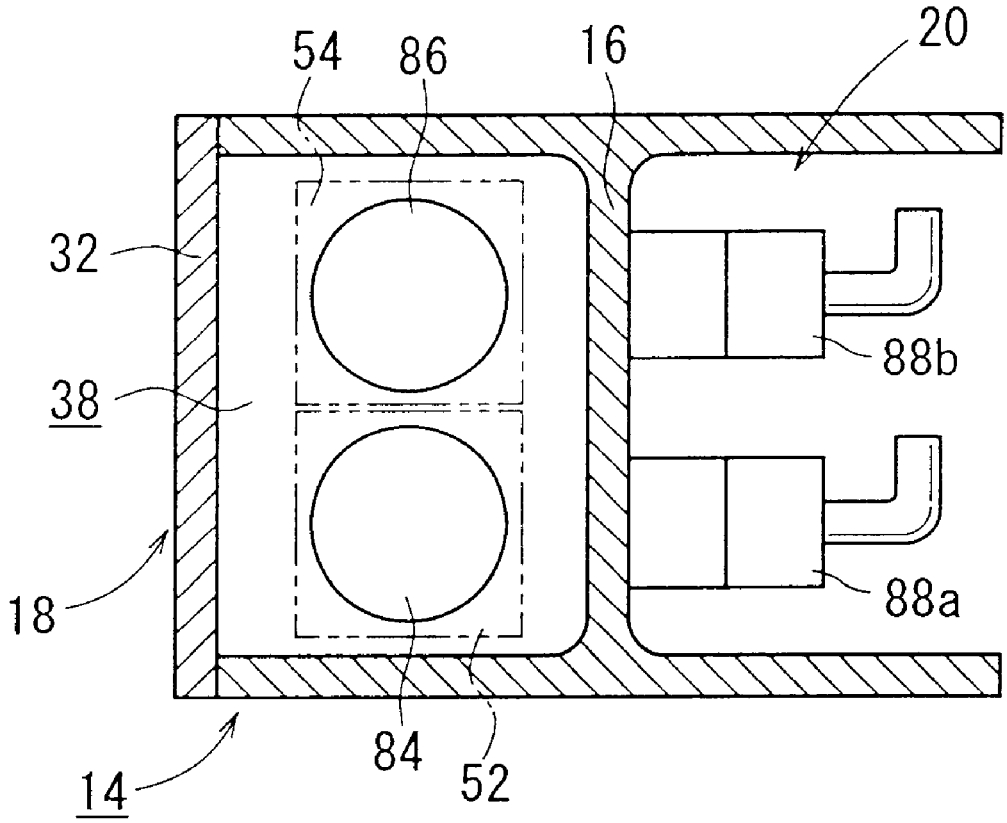
FIG. 4 is a cross-sectional view taken along line IV—IV of FIG. 1.

As shown in FIGS. 1 and 2, the robot-mounted two-package-mixing coating device 10 is incorporated in a robot arm 14 of the coating robot 12. As shown in FIGS. 3 and 4, the robot arm 14 is constructed of an I-shaped or H-shaped steel bar. The robot arm 14 has a first housing region 18 and a second housing region 20 which are separated by a partition wall 16 that extends in the direction indicated by the arrow X which is the longitudinal direction of the robot arm 14. The robot arm 14 also has a pair of walls 22*a*, 22*b* near a distal end thereof in the direction indicated by the arrow X. The walls 22*a*, 22*b* extend in the transverse direction of the robot arm 14, i.e., in the direction indicated by the arrow Y. The walls 22*a*, 22*b* may be integrally formed with the robot arm 14 or separately formed and attached to the robot arm 14. The robot arm 14 further has a wall 24 near a proximal end thereof. The wall 24 may be integrally formed with the robot arm 14 or separately formed and attached to the robot arm 14.

As shown in FIGS. 1 and 3, the robot arm 14 has a pair of closure walls 26*a*, 26*b* at spaced positions in the first housing region 18. The closure walls 26*a*, 26*b* may be integrally formed with the robot arm 14 or separately formed and attached to the robot arm 14. The closure walls 26*a*, 26*b* have a plurality of threaded holes 28*a*, 28*b* defined in outer side edges thereof. The robot arm 14 has a plurality of threaded holes 30*a*, 30*b* defined in upper and lower side edges thereof between the closure walls 26*a*, 26*b*. A lid 32 is mounted on the robot arm 14 using the threaded holes 28*a*, 28*b*, 30*a*, 30*b*.

Specifically, as shown in FIG. 3, the lid 32 has a plurality of through holes 34 defined therein. Mounting screws 36 are inserted through the respective through holes 34 and threaded into the threaded holes 28*a*, 28*b*, 30*a*, 30*b*, fastening the lid 32 to the robot arm 14. The robot arm 14, the closure walls 26*a*, 26*b*, and the lid 32 define a pressurization chamber 38 therebetween in the first housing region 18. The pressurization chamber 38 is supplied with air under pressure from a pressurized air supply source, not shown.

As shown in FIGS. 1 and 2, the coating robot 12 has a coating gun 40 mounted on the distal end of the wrist of the robot arm 14. The robot arm 14 houses therein a first color changing valve mechanism (control valve mechanism) 44 actuatable by air for supplying a base compound 42, a second color changing valve mechanism (control valve mechanism) 48 actuatable by air for supplying a hardener 46, an electropneumatic transducer 50 for controlling air to be supplied to the first and second color changing valve mechanisms 44, 48, and first and second gear pumps 52, 54 for delivering the base compound 42 and the hardener 46 under pressure to the coating gun 40.

In the robot arm 14, the first color changing valve mechanism 44, the electropneumatic transducer 50, and the second color changing valve mechanism 48 are successively arranged in the order named toward the coating gun 40, i.e., in the direction indicated by the arrow X.

Figure 5:
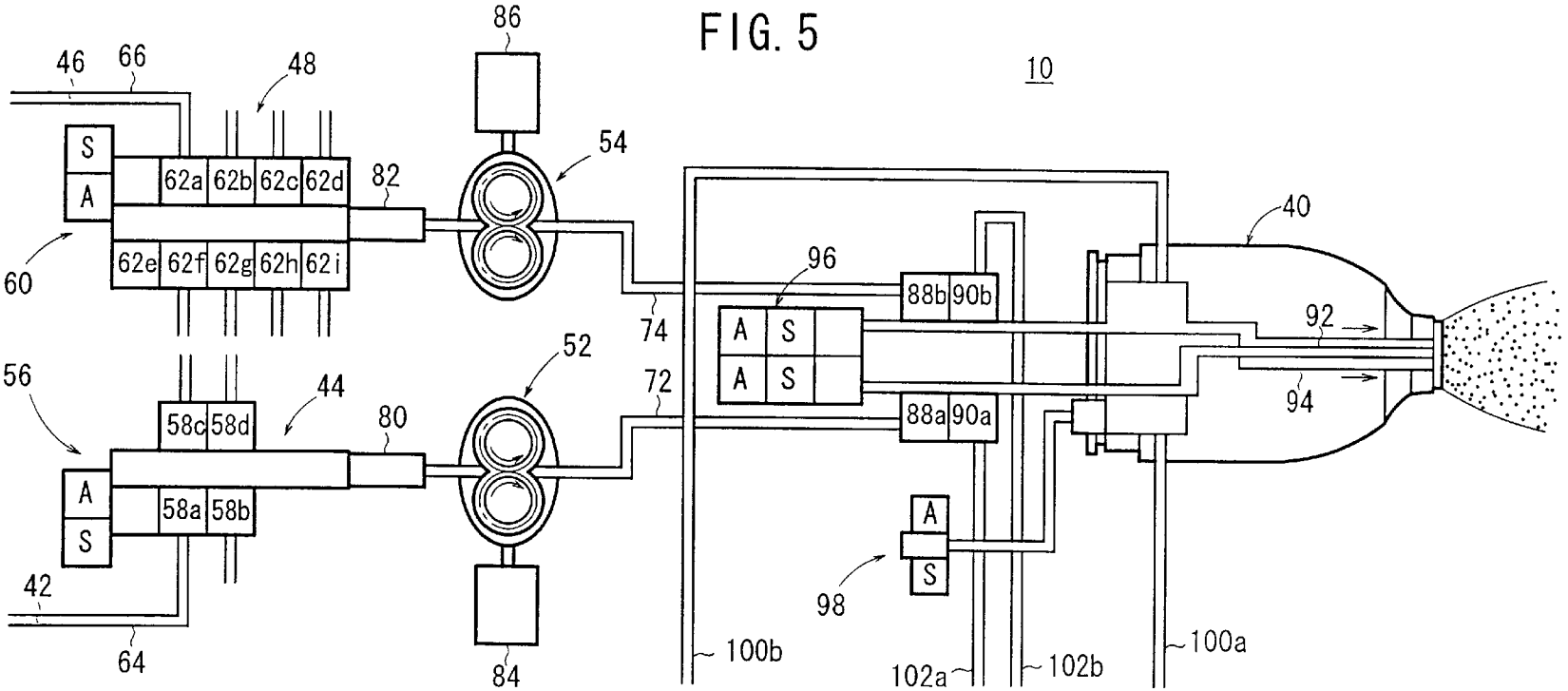
FIG. 5 is a schematic view of the internal pressure explosion-proof coating robot.
Figure 6:
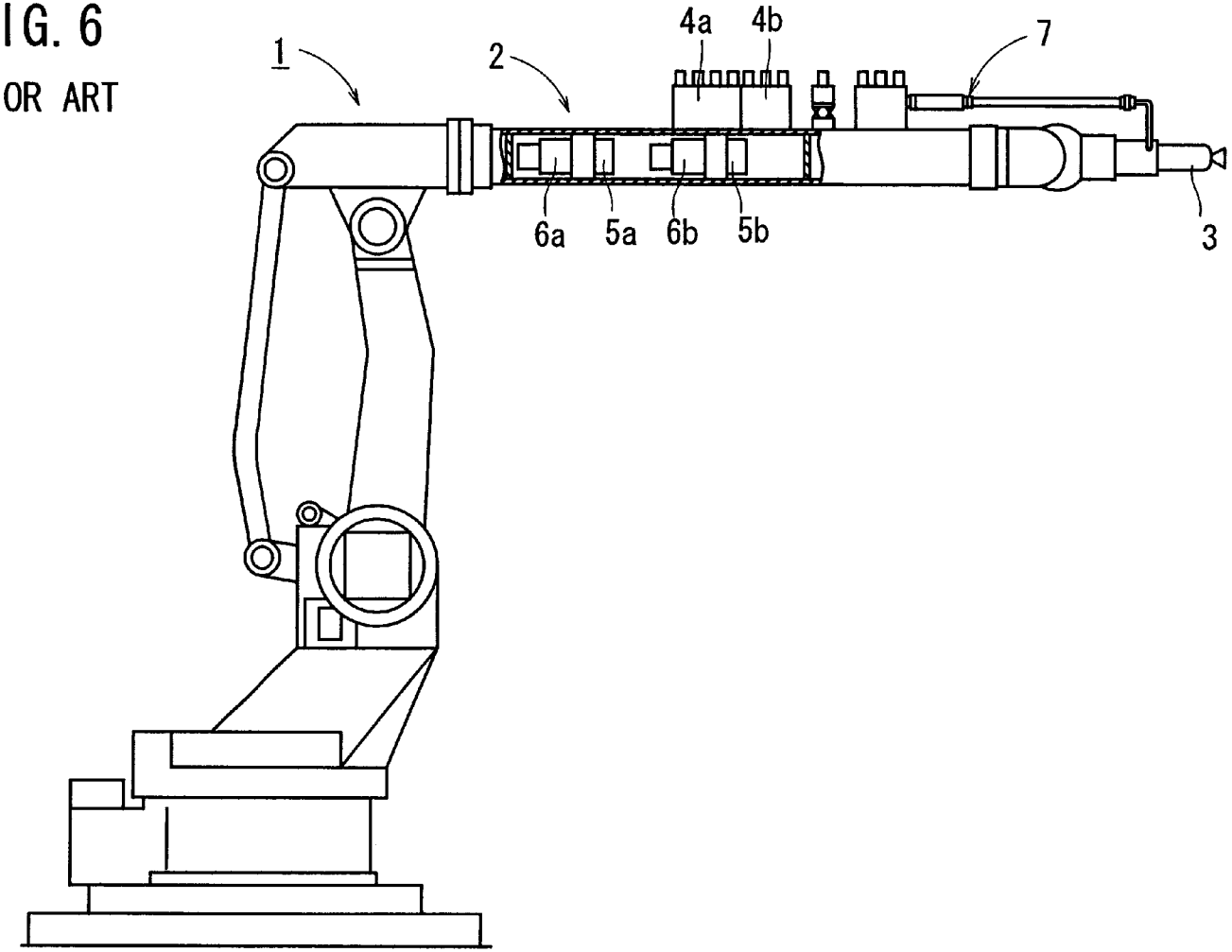
FIG. 6 PRIOR ART
FIG. 6 is a side elevational view, partly in cross section, of a conventional coating device.

As shown in FIG. 5, the first color changing valve mechanism 44 comprises a first cleaning valve 56 for controlling the supply of air (A) and a cleaning liquid (S), and a plurality of control valves 58*a* through 58d for supplying base compounds 42 corresponding to coating liquids of different colors. Similarly, the second color changing valve mechanism 48 comprises a second cleaning valve 60 for controlling the supply of air (A) and a cleaning liquid (S), and a plurality of control valves 62*a* through 62i for supplying hardeners 46 corresponding to coating liquids of different colors. The control valves 58*a* through 58d, 62*a* through 62*i* are connected to base compound reservoirs and hardener reservoirs (not shown) respectively through base compound passages 64 and hardener passages 66.

As shown in FIGS. 1 and 2, air tubes 68, 70 for supplying air (A) have ends connected to input ports 67*a*, 67*b* of the control valves 58*a* through 58d, 62*a* through 62i, and other ends connected to output ports 71*a*, 71*b* of the electropneumatic transducer 50. The electropneumatic transducer 50 is disposed between the first and second color changing valve mechanisms 44, 48, and the air tubes 68, 70 have respective lengths which are substantially the same as each other.

A base compound supply passage 72 and a hardener supply passage 74 for supplying the base compound 42 and the hardener 46, respectively, to the coating gun 40 are connected respectively to the first and second color changing valve mechanisms 44, 48. As shown in FIG. 5, the base compound supply passage 72 and the hardener supply passage 74 have respective first and second gear pumps 52, 54 for delivering each of the base compounds 42 and each of the hardeners 46 under pressure to the coating gun 40, and respective first and second pressure control valves 80, 82 disposed respectively upstream of the first and second gear pumps 52, 54 for controlling the base compound 42 and the hardener 46 to be fed under predetermined pressures to the first and second gear pumps 52, 54. First and second servomotors (electric devices) 84, 86 are connected to the first and second gear pumps 52, 54, respectively.

Trigger valves 88*a*, 88*b* and drain valves 90*a*, 90*b* are connected to outlet ports of the base compound supply passage 72 and the hardener supply passage 74. The coating gun 40 houses an inner tube 92 and an outer tube 94 which are openably and closably connected to the base compound supply passage 72 and the hardener supply passage 74 respectively by the trigger valves 88*a*, 88*b*.

The inner tube 92 can communicate with the base compound supply passage 72, and extends centrally in the coating gun 40. The outer tube 94 can communicate with the harder supply passage 74, and is disposed around the inner tube 92 in the coating gun 40. The coating gun 40 is connected to a third cleaning valve 96 and a second cleaning valve 98, and is also connected to drain pipes 10*a*, 10*b*. Drain pipes 102*a*, 102*b* are connected respectively to the drain valves 90*a*, 90*b*.

As shown in FIG. 1, the first and second color changing valve mechanisms 44, 48 and the trigger valves 88*a*, 88*b* are mounted in the second housing region 20 in the robot arm 14. The electropneumatic transducer 50 is mounted in the first housing region 18 in closing relation to an opening 110 defined in the partition wall 16 of the robot arm 14. As shown in FIG. 3, the first and second gear pumps 52, 54 are mounted in the first housing region 18 and fixed to a side face of the closure wall 26*a* which faces the wall 22*a*. The first and second servomotors 84, 86 coupled to the first and second gear pumps 52, 54 are housed in the pressurization chamber 38 that is defined between the closure walls 26*a*, 26*b*. The closure wall 26*a* has a pair of vertically spaced holes 114, 116 defined therein through which joints between the first and second gear pumps 52, 54 and the first and second servomotors 84, 86 are inserted.

With the first and second servomotors 84, 86 housed in the pressurization chamber 38, the lid 32 is held against the side edges of the closure walls 26*a*, 26*b*. The mounting screws 36 are inserted through the holes 34 and threaded into the threaded holes 28*a*, 28*b*, 30*a*, 30*b*, fastening the lid 32 to the closure walls 26*a*, 26*b*. The pressurization chamber 38 now creates a closed space in the pressurization chamber 38, which is supplied with air under pressure.

Operation of the coating robot 12 thus constructed will be described below.

In the first and second color changing valve mechanisms 44, 48, as shown in FIG. 5, the control valves 58*a*, 62*a*, for example, are opened by the electropneumatic transducer 50 to deliver the base compound 42 and the hardener 46 which correspond to a certain coating under pressure from the first and second color changing valve mechanisms 44, 48 via the base compound passage 64 and the hardener passage 66 to the base compound supply passage 72 and the hardener supply passage 74.

The first and second gear pumps 52, 54 are actuated by the respective first and second servomotors 84, 86 to deliver the base compound 42 and the hardener 46 at respective rates downstream through the base compound supply passage 72 and the hardener supply passage 74. The trigger valves 88*a*, 88*b* are opened to supply the base compound 42 and the hardener 46 respectively to the inner tube 92 and the outer tube 94, and then discharged from the inner tube 92 and the outer tube 94 and mixed with each other at the tip end of the coating gun 40. The mixture is then applied as a coating layer from the coating gun 40 to a workpiece, not shown.

According to the present embodiment, as shown in FIGS. 1 and 2, the first color changing valve mechanism 44, the electropneumatic transducer 50, and the second color changing valve mechanism 48 are successively arranged in the robot arm 14 in the order named toward the coating gun 40, as shown in FIGS. 1 and 2. Therefore, the air tube 68 for supplying air to the control valves 58*a* through 58*d* of the first color changing valve mechanism 44, and the air tube 70 for supplying air to the control valves 62*a* through 62*i* of the second color changing valve mechanism 44 have respective lengths which are substantially the same as each other.

Therefore, when an electric signal is applied to the electropneumatic transducer 50 to supply air via respective air tubes 68, 70 to open the control valves 58*a*, 62*a*, for example, the control valves 58*a*, 62*a* are simultaneously opened because the air tubes 68, 70 have the same length. Thus, the first and second color changing valve mechanisms 44, 48 respond at the same time to air supplied from the electropneumatic transducer 50, and the base compound 42 and the hardener 46 are discharged at stable rates and mixed highly accurately at a desired mixing ratio. As a result, a high-quality coating layer can be applied to the workpiece.

Furthermore, the first color changing valve mechanism 44, the electropneumatic transducer 50, and the second color changing valve mechanism 48 are successively arranged in the direction indicated by the arrow X in the robot arm 14.

Therefore, the available space in the robot arm 14 can effectively be utilized, allowing the coating robot 12 to be reduced in size with ease.

The hardener 46 is discharged at a rate smaller than the base compound 42, and the hardener supply passage 74 is thinner than the base compound supply passage 72. The hardener 46 is more viscous than the base compound 42. Therefore, it takes a longer period of time to clean the hardener supply passage 74 than the base compound supply passage 72.

According to the present embodiment, the second color changing valve mechanism 48 is positioned more closely to the coating gun 40 than the first color changing valve mechanism 44. Therefore, the hardener supply passage 74 is shorter than the base compound supply passage 72, and the time required to clean the hardener supply passage 74 is effectively reduced. As a consequence, the cleaning process that is carried out when coating colors are changed in the coating device 10 is efficiently performed.

The base compound supply passage 72 and the hardener supply passage 74 are cleaned by opening the first and second cleaning valves 56, 60 to introduce the cleaning liquid into the base compound supply passage 72 and the hardener supply passage 74, and actuating the first and second gear pumps 52, 54 to deliver the cleaning liquid toward the coating gun 40.

In the present embodiment, the robot arm 14 is constructed of a steel bar having an I-shaped or H-shaped cross section (I-shaped or H-shaped steel bar). Therefore, the robot arm 14 has an effective level of overall mechanical strength.

As shown in FIG. 3, in the first housing region 18 of the robot arm 14, the closure walls 26*a*, 26*b* are spaced from each other by a distance which corresponds to the lengths of the first and second servomotors 84, 86 in the direction indicated by the arrow X. When the lid 32 is screwed over the closure walls 26*a*, 26*b*, the pressurization chamber 38 is closed. Therefore, when electric devices that are required to be resistant to explosions, such as the first and second servomotors 84, 86, for example, are housed in the pressurization chamber 38, and air under pressure is supplied to the pressurization chamber 38, a simple explosion-proof structure for the first and second servomotors 84, 86 is reliably provided.

In the present embodiment, the robot arm 14 is constructed of an I-shaped or H-shaped steel bar, and the pressurization chamber 38 may be defined in a portion of the robot arm 14 simply by providing the closure walls 26*a*, 26*b* integrally or separately at a desired position. Thus, a simpler desired explosion-proof structure can be provided at a desired position more easily than with the conventional tubular robot arm. The explosion-proof structure is excellent in versatility and economical as it can be manufactured less costly.

The pressurization chamber 38 can be opened to the exterior simply by detaching the lid 32. Therefore, the first and second servomotors 84, 86 can be inspected or serviced for maintenance with ease and efficiency.

The present embodiment has been described with respect to the coating robot 12 which uses a two-package-mixed coating. However, the principles of the present invention are also applicable to a coating robot which uses a one-package coating or a robot arm in which various electric devices required to be resistant to explosions are mounted.

In the robot-mounted two-package-mixing coating device according to the present invention, the base compound supply control valve mechanism, the electropneumatic transducer, and the hardener supply control valve mechanism are successively arranged in the order named toward the coating gun in the robot arm. Therefore, the passages for supplying air from the electropneumatic transducer to the base compound supply control valve mechanism and the hardener supply control valve mechanism can be set to substantially the same length, allowing the base compound supply control valve mechanism and the hardener supply control valve mechanism to respond at the same time.

Therefore, the base compound supply control valve mechanism and the hardener supply control valve mechanism supply the base compound and the hardener stably at desired rates, and the base compound and the hardener are mixed with each other at a highly accurate mixing ratio to apply a high-quality coating layer on the workpiece.

In the internal pressure explosion-proof robot according to the present invention, the pressurization chamber is closed by attaching the lid to the robot arm which is constructed of an I-shaped or H-shaped steel bar. Consequently, the robot arm itself maintains a desired level of mechanical strength with a simple and inexpensive structure, and allows a desired explosion-proof structure to be incorporated in a portion thereof. The explosion-proof structure is applicable to a robot arm which houses various electric devices therein. The electric devices in the explosion-proof structure can be inspected or serviced for maintenance with ease and efficiency simply by detaching the lid. The explosion-proof structure is simple and highly versatile.

Although a certain preferred embodiment of the present invention has been shown and described in detail, it should be understood that various changes and modifications may be made therein without departing from the scope of the appended claims.

What is claimed is:

1. A robot-mounted two-package-mixing discharging device comprising:

a robot arm with a coating gun mounted on a distal end thereof;

a base compound supply control mechanism mounted in said robot arm and actuatable by air for supplying a base compound;

a hardener supply control mechanism mounted in said robot arm and actuatable by air for supplying a hardener; and an electropneumatic transducer mounted in said robot arm for controlling air to be supplied to said base compound supply control mechanism and said hardener supply control mechanism;

said base compound supply control mechanism, said electropneumatic transducer, and said hardener supply control mechanism being successively arranged in said robot arm in the order named toward said coating gun.

2. A robot-mounted two-package-mixing discharging device according to claim 1, further comprising:

an air tube for supplying air from said electropneumatic transducer to said base compound supply control mechanism; and an air tube for supplying air from said electropneumatic transducer to said hardener supply control mechanism;

said air tubes having respective lengths which are substantially the same as each other.

3. A robot-mounted two-package-mixing discharging device according to claim 1, wherein said robot arm is constructed of a steel bar having an I-shaped or H-shaped cross section, further comprising:

a lid mounted on at least one side of said robot arm, defining a closed pressurization chamber in said robot arm, said pressurization chamber housing electric devices therein and supplied with air under pressure.

4. A robot-mounted two-package-mixing discharging device according to claim 3, wherein said electric devices include servomotors for actuating gear pumps for delivering said base compound and said hardener under pressure to said coating gun.

5. An internal pressure explosion-proof robot comprising:

a robot arm constructed of a steel bar having an I-shaped or H-shaped cross section;

a pair of closure walls spaced from each other and provided on one side of said steel bar;

a lid mounted on said one side of said robot arm in contact with said one side of the robot arm and said closure wall; and a closed pressurization chamber defined by said robot arm, said pair of closure walls and said lid, housing electric devices therein, and supplied with air under pressure.

6. An internal pressure explosion-proof robot according to claim 5, further comprising:

a coating gun mounted on a distal end of said robot arm;

a base compound supply control mechanism mounted in said robot arm and actuatable by air for supplying a base compound;

a hardener supply control mechanism mounted in said robot arm and actuatable by air for supplying a hardener; and an electropneumatic transducer mounted in said robot arm for controlling air to be supplied to said base compound supply control mechanism and said hardener supply control mechanism.

* * * * *